US007161101B2

(12) United States Patent
Scavella

(10) Patent No.: US 7,161,101 B2
(45) Date of Patent: Jan. 9, 2007

(54) LAMP-SOCKET WITH BUILT-IN SWITCH

(76) Inventor: Gabriel Scavella, De Maria Street, 4439, 4th floor B (1425), Buenos Aires (AR)

( * ) Notice: Subject to any disclaimer, the term of this patent is extended or adjusted under 35 U.S.C. 154(b) by 0 days.

(21) Appl. No.: 11/141,410

(22) Filed: Jun. 1, 2005

(65) Prior Publication Data

US 2006/0278506 A1 Dec. 14, 2006

(51) Int. Cl.
*H01R 33/955* (2006.01)

(52) U.S. Cl. ..... 200/51 R; 200/51.17

(58) Field of Classification Search ..... 200/51 R, 200/51.11–51.17, 330, 331; 315/362; 362/95, 362/394, 395, 410; 439/218, 220, 620, 667, 439/336, 613, 615, 761, 666, 614, 640, 168
See application file for complete search history.

(56) References Cited

U.S. PATENT DOCUMENTS 4,668,845 A * 5/1987 Izumi ..... 200/51 R
5,783,788 A * 7/1998 Jones et al. ..... 200/51.17
6,227,912 B1 * 5/2001 Hung ..... 200/51.17
6,396,009 B1 * 5/2002 Yu ..... 200/51 R
6,768,072 B1 * 7/2004 Yang ..... 200/329

* cited by examiner

*Primary Examiner*—Michael A. Friedhofer
(74) *Attorney, Agent, or Firm*—Norris McLaughlin & Marcus PA

(57) ABSTRACT

Lamp-socket with built-in switch, wherein the switch can to be driven by a knob, a cord, a chain or a lever associated with a type "ratchet" mechanism which allows to close and to open the lamp power supply connection contacts. On transversal plane defined in the back end of its frontal side, the lamp-socket has a perpendicular connection bridge where the switching mechanism is laterally engaged, this is confined according with the projection of the gap defined by the lamp-socket frontal side perimeter and by the height of the bridge upper transversal edge. The switching mechanism, according to the possible embodiments, is conformed by a "ratchet sleeve" associated with a cam or "lever creek" in order to actuate it by a cord or a chain, or by a revolving bushing actuated by a knob or a "L" shaped lever. The switching mechanism is generally small shaped and, as a result of being laterally engaged on the connection bridge, it occupies a space so as it allows the lamp-socket to be substantially as height and to have a diameter as any conventional lamp-socket.

8 Claims, 5 Drawing Sheets

LAMP-SOCKET WITH BUILT-IN SWITCH

BACKGROUND OF THE INVENTION

1. Field of the Invention

The present invention refers to a lamp-socket built-in switch, and particularly it is a modular lamp-socket where the switch is defined by a mechanism specially developed to be built-in in the lamp-socket. So, this has been properly adapted too.

2. Description of the Prior Art

Diverse types of lamp-sockets that include or incorporate a turning on-tuning off switch to actuate the lamp from the body of the lamp-socket are well known in the prior art. This way, it has been tried to offer to the devices and electrical accessories market a type of lamp-socket that is specially suitable for temporary or circumstantial facilities, instead of being suitable to be permanently installed in devices as spot lamps, hanging lights, hanging lights, etc.

Among these conventional lamp-sockets those where in its back side, it is to say in the opposite side that defines the lamp placing cavity, have laterally placed over the access-to-contacts bridge and connection contacts, a switch or switch key. This is of the conventional type frequently used in diverse electrical and electronic devices. These lamp-sockets are considerably higher than those that have no switch. So, its implementation is limited to certain type of devices or to be used independently in provisional facilities.

In other conventional lamp-sockets, the built-in switch is of the type rotating driven by means of a lateral knob. In this case, as it happens in the lamp-socket above mentioned, the switching mechanism as its knob are located in the lamp-socket body back end, over the contacts bridge and the connection terminals. The switching mechanism has generally a rudimentary construction that tends to generate sparks when closing and opening its contacts. As a result of this, its lifetime is usually relatively short.

On the other hand, lamp-sockets that include a mechanism that operates with a type "ratchet" mechanism actuated by means of a cord or chain that hangs from the lamp-socket are well known too. Even though it can be affirmed that such type "creek" switches use to have a longer lifetime than those that are driven by means of rotating mechanisms that include a knob, as those mentioned in the paragraph above, these also occupy a considerable space in the back end of the lamp-socket. By this reason they do not solve the problem that represents the excessive height of the lamp-socket.

In order to overcome the disadvantages and limitations of the conventional lamp-sockets that include the switch as previously mentioned, the lamp-socket object of the present invention has been developed. Additionally, this one has remarkable constructive and functional advantages, as follows.

In effect, after a careful design of each one of the parts necessary to overcome the disadvantages and limitations of the up to now known lamp-sockets, an extremely versatile modular lamp-socket has been developed. This is because beginning from a basic module three different ways of switch operation can be obtained. That is to say, by means of a rotating switch operation, cord operation or and lever operation, using common pieces in the three cases. In addition, in merit to its reduced size, connection way and location of the switching mechanism, it has been reached this lamp-socket to be considerably shorter than the built-in lamp-sockets known up to now. Thus, it can be used without disadvantages in diverse types of illumination devices. Furthermore, it also allows to freely design new models of devices capable of being used any type of lamp-sockets, having or not built-in switch. It is possible to affirm that the "modular" characteristic of this lamp-socket becomes it a product that allows to include in the same body the lamp-socket, the switch and, in addition, to make possible its use as lampshade socket. On the other hand, referring to the industrial production of the mentioned lamp-socket, its special design makes possible the fast and easy assembly of each one of its parts, considering too a high quality, electrical security and a low cost of manufacture and sale.

SUMMARY OF THE INVENTION

It is therefore one object of present invention to provide a lamp-socket with built-in switch, where switch can to be driven by means of a knob, a cord, a chain or a lever associated with a type "ratchet" mechanism that allows to close and to open the lamp power supply connection contacts through the corresponding terminals, wherein in lamp-socket back side a connection bridge is conformed, this connection bridge is projected in perpendicularly way and centrally behind the lamp-socket tubular frontal part, that defines the lamp receiving cavity, said bridge is defined by a pair of lateral walls, these lateral walls present lateral edges that are next to the contour of lamp-socket frontal portion and respective transversal upper edges that defines the back end of the bridge, wherein the lamp-socket switching mechanism is connected in a lateral plane of the lamp-socket connection bridge and behind of the lamp-socket frontal tubular part, being this switching mechanism confined coincident with the projection of the gap defined by the perimeter of the lamp-socket frontal part and by the height of the of this bridge transversal edge.

BRIEF DESCRIPTION OF THE DRAWINGS

The present invention is illustrated by way of example in the following drawings wherein.

DESCRIPTION OF THE PREFERRED EMBODIMENTS

Figure 1:
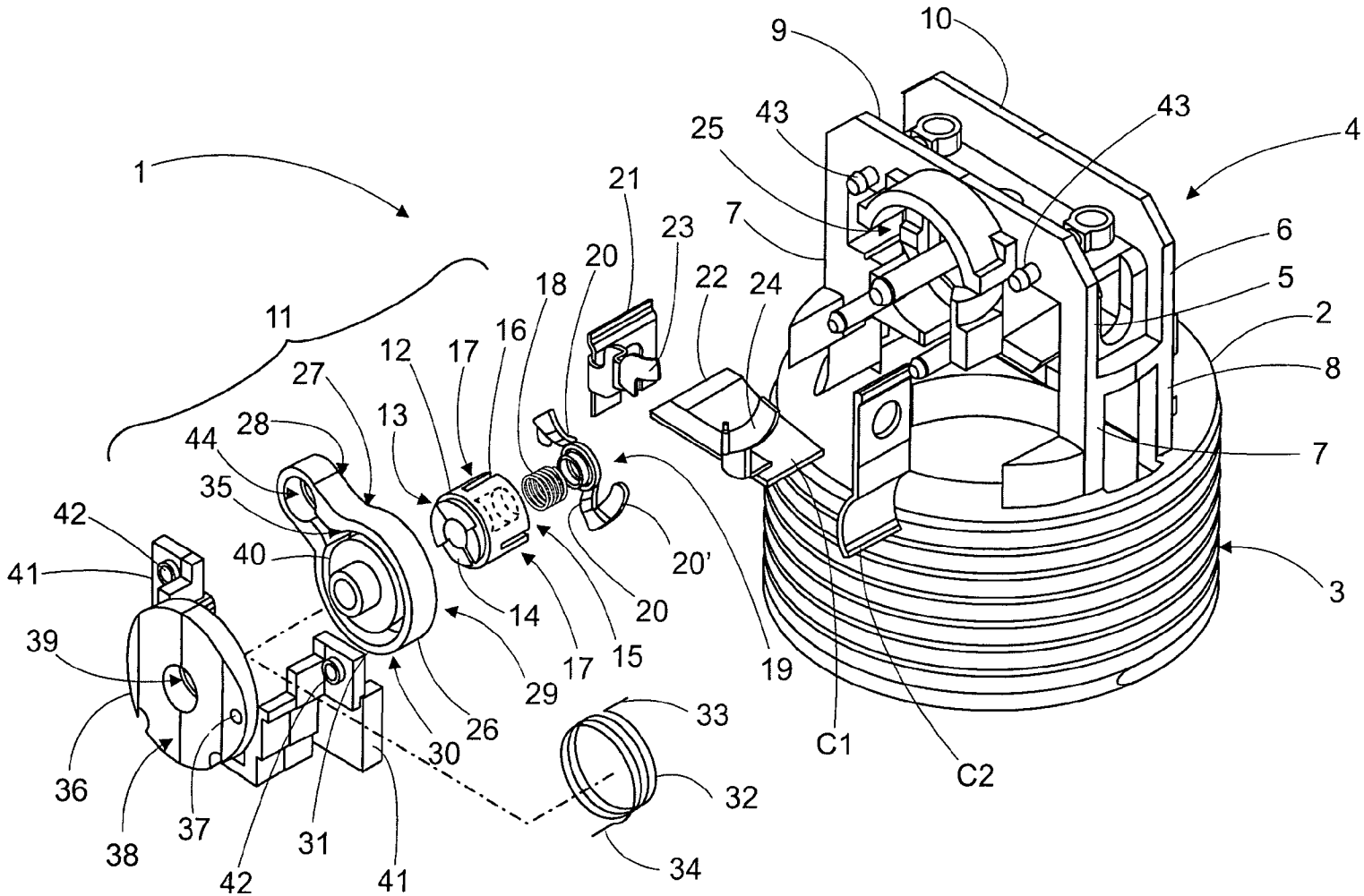
FIG. 1 is a exploded and in perspective view that shows the main component parts of the lamp-socket and of the corresponding switch according to the present invention, being not included in this figure the lamp-socket back end closing cap nor other secondary elements or accessories.
Figure 2:
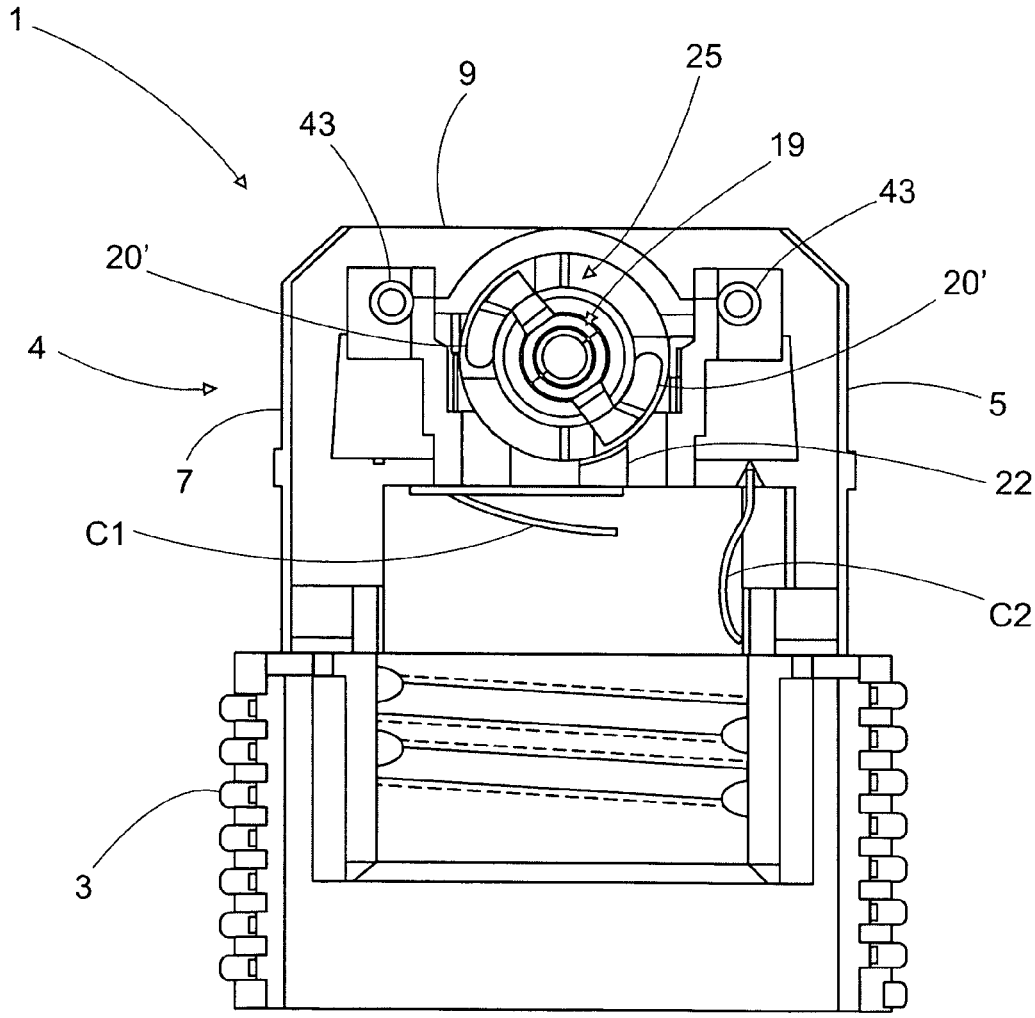
FIG. 2 is a lateral and partially cross sectional view in plant of the lamp-socket of the preceding figure, where it can be specially seen the contact means that are actuated by means of the switching mechanism built in the lamp-socket.

Now referring in detail to the invention, the same refers to a device indicated by general reference number 1 in FIGS. 1 and 2, wherein it can been clearly seen the lamp-socket with built-in switch object of the present invention. It comprises a main body 2 that has a tubular frontal part 3, that defines the corresponding lamp receiving cavity, in this particular example it is externally threaded to allow to mount a lampshade, and a back end 4, or connection bridge, that includes the contacts and connection terminals of the lamp power supply.

The connection bridge 4 is projected in perpendicular way and centrally behind the lamp-socket tubular frontal part 3, said bridge 4 is defined by a pair of lateral walls 5 and 6, these lateral walls present lateral edges 7 and 8 that are next to the contour of lamp-socket frontal portion 3 and respective transversal upper edges 9 and 10 that define the back end of the bridge.

The switching mechanism, indicated altogether with the reference 11, incorporated to the lamp-socket according to the present invention, is connected in a lateral plane of the connection bridge 4 and behind the frontal end 3 of main body 2, being this switching mechanism 11 confined coincident with the projection of the gap defined by the perimeter of the lamp-socket frontal part 3 and by the height of the of this bridge transversal edges 9 and 10.

This structural characteristic of lamp-socket 1 is the one that makes possible it to have an equal perimeter and be as height as any of the conventional lamp-socket that does not have a built-in switching mechanism, generating so the remarkable advantages already mentioned.

The switching mechanism 11 includes a ratchet sleeve 12 that has a frontal side 13 in which a plurality of inclined annular steps 14 are defined, and in a back end 15 that has a tubular cavity 16 and a pair of longitudinal diametrically opposed grooves 17. This tubular cavity 16 defines a place for the engaging of a compression spring 18 that actuate on a type spiral (or type helix or type propeller) electrical bridge 19, whose lateral opposed brackets 20, that end in contacts ends 20', respectively engage in those longitudinal grooves 17. The spring 18 exerts on the electrical bridge 19 enough pressure to assure an express and efficient closing of the electrical circuit among terminals 21 and 22, and more specifically among the respective paths 23 and 23. These paths are frontally placed on the connection bridge 4 of the main body 2 and are extended in concordance with the respective inclined annular steps 25 conformed laterally on the bridge 4. In the terminal 22, the central contact for the lamp is indicated as C11, whereas the lateral contact is indicated as C2.

On the other hand, ratchet sleeve 12 is in operative communication with the cam or lever-creek 26, from its frontal end 13. This cam or lever-creek is defined by a disc shaped portion 27 and an lever arm 28 that projects laterally from this disc shaped portion 27. In the back side 29 of the lever-creek 26 a ratchet sleeve receiving cavity 12 (hidden in the figures) is defined and where a plurality of inclined annular steps is conformed, being this annular steps in operative communication with the ratchet sleeve 12 annular steps. The frontal side 30 of disc shaped portion 27 of lever-creek 26 presents an annular cavity 31 where are placed the spires of retractable spring 32. This spring 32 makes possible the return of the lever-creek to its resting after each operation of the same one. The spring 32 concretely has an end 33 placed into a retention orifice 35 conformed in lever-creek 26, whereas a second end 34 of the spring 32 is placed and retained in a back cover 36 destined to fasten the switching mechanism, and more concretely into an orifice 37 made in the back cover 36.

Figure 3:
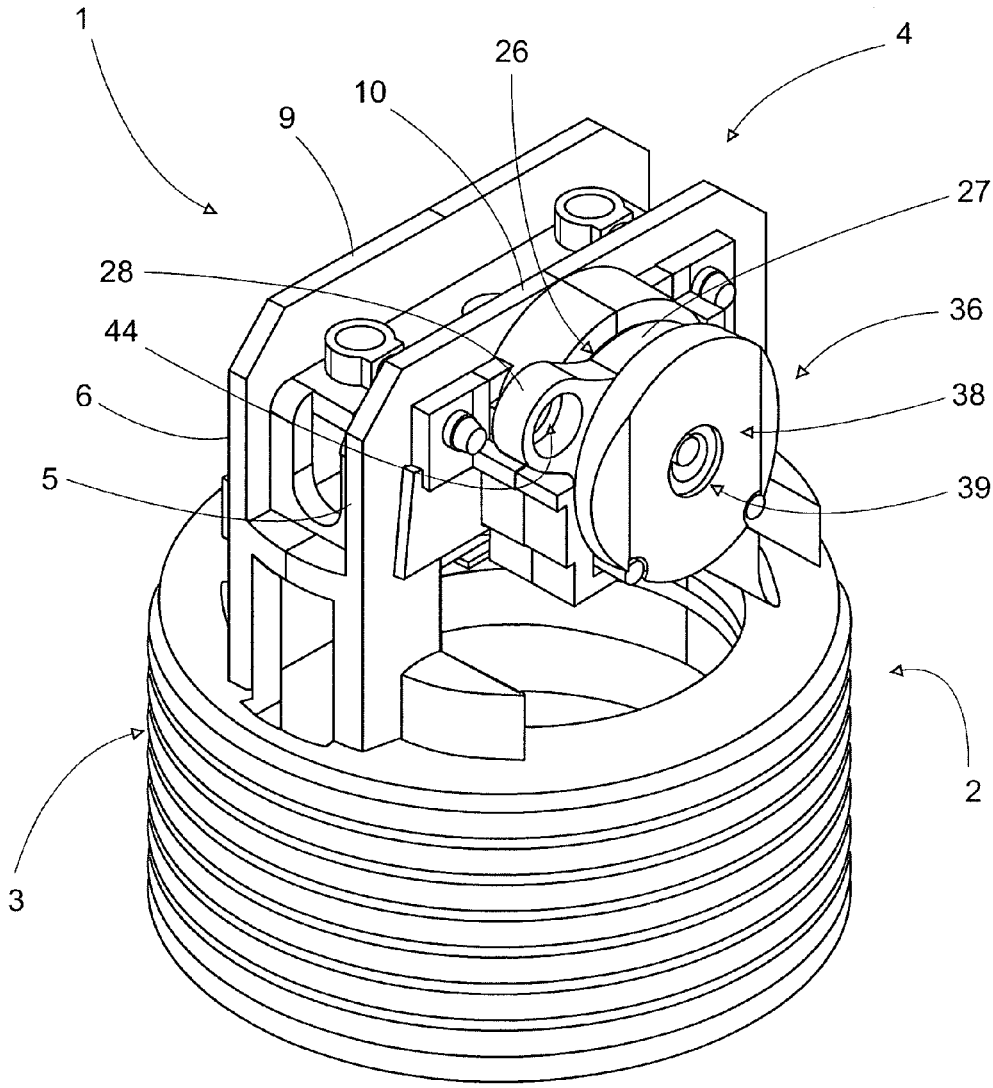
FIG. 3 an in perspective view of the lamp-socket with built-in switch according to FIG. 1, but showing now the same component parts already mounted each other.

As shown in FIG. 1 and, more clearly in FIG. 3, cover 36 has a main portion 38 that includes a central orifice 39. A central tubular projection 40 conformed in the disc shaped portion 27 of lever-creek 26 passes through this orifice 39. In order to keep mounted the switching mechanism 11 by means of cover 36, this includes lateral brackets 41 with respective orifices 42 for the passage of retention projections 43 that are projected from bridge 4. This way, the ensemble integrated by the cover 36 and the mechanism 11 attached to the bridge 4 of main body 2 of lamp-socket 1, remain assembled.

In order to actuate the switching mechanism 11, if it is considered more convenient, the end of a cord or a chain is attached to an orifice 44 placed in arm 28 of lever-creek 26. This way, every time said chain or cord is pulled the lever-creek 26 turns a quarter of twist on the disc shaped portion 27 geometrical rotation axis. This way, inclined steps defined in the back side 29 exert pushing force on steps 14 of bushing 12 and so the bushing 14 turns along bridge 19, which as well moves closing or opening (according to the corresponding position) the electrical circuit defined among tracks 23 and 24 of terminals 21 and 22 fixed to the connection bridge 4.

Figure 4:
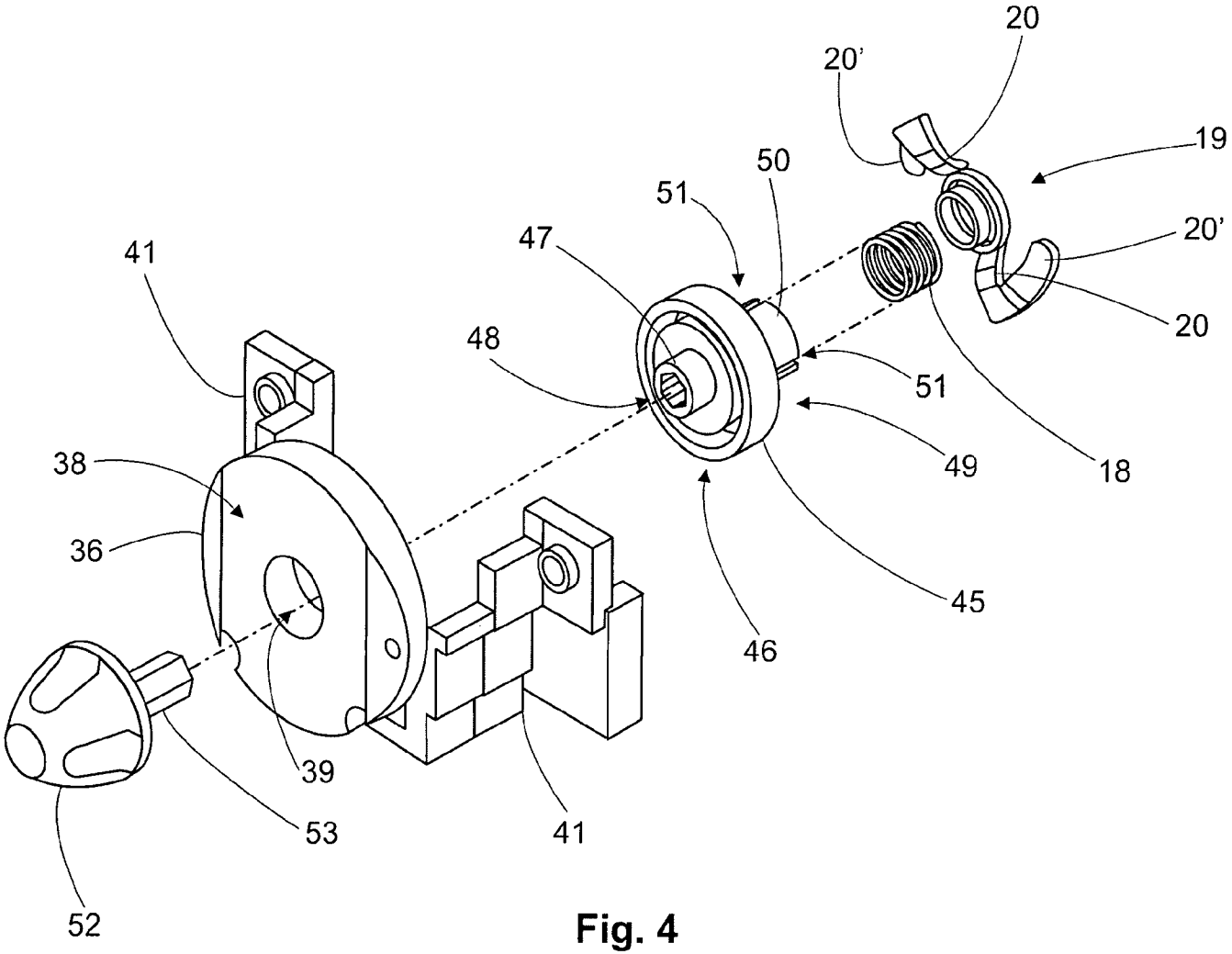
FIG. 4 is an exploded and in perspective view that shows an embodiment of the switching mechanism, as it has been developed to be actuated by means of a knob or an outer lever.

Making reference now to FIG. 4, where references to equal or equivalent components remain the same as in previous figures, it can be seen that the ratchet sleeve 26, the lever-creek 12 and the retractile spring 32 have been replaced by a rolling bushing 45. This rolling bushing 45 is directly actuated by means of a knob or an outer lever. This revolving bushing 45 has a frontal side 46 that includes a first central tubular projection 47 where a polygonal orifice 48, preferably hexagonal, is conformed, and a backside 49 that has a second tubular projection 50. This second tubular projection 50 includes, as the ratchet sleeve 12, a pair of diametrically opposed longitudinal grooves 51, wherein respective lateral brackets 20 of the electrical type-spiral bridge 19 engage. Also, in analogous form to the embodiment previously described, the tubular projection 50 of revolving bushing 45 defines a cavity where the compression spring 18 that actuates on bridge 19 is placed.

According to the embodiment, the switching mechanism is actuated by means of a knob 52 from which an axis or stem 53 is projected that pass through orifice 38 of cover 36 and is inserted in the orifice 48 of the tubular projection 47 of revolving bushing 45. It is possible to mention that even though the knob 52 has been illustrated, it is also contemplated among other alternatives, actuating the switching mechanism by means of a "L" shaped lever, whose smaller leg has cross-sectional section that is coincident with the polygonal geometry of orifice 48 of the bushing 45.

In this embodiment of the lamp-socket of the present invention, when knob 52 is turned, the revolving bushing 45 turns too in tandem with bridge 19. This bridge 19 moves, thus closing or opening the electrical circuit among paths 23 and 24 of terminals 21 and 22 (attached to the connection bridge 4).

It is possible to mention that in both embodiments described above, paths 23 and 24 of terminals 21 and 22 are extend on inclined steps, allowing this way to cut rapidly the electrical current, thus avoiding or reducing considerably the production of disconnection sparks and, consequently, increasing the corresponding contacts lifetime.

Figure 5:
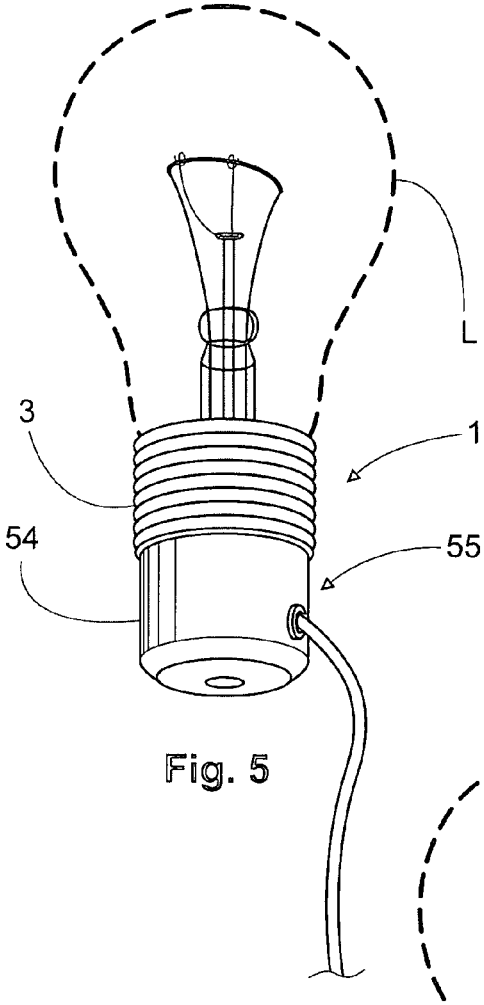
FIGS. 5 to 7 show the lamp-socket of the present invention according to the embodiments and in which a protective cap and including a lamp, being this lamp controlled by means of the corresponding switching mechanisms.

FIG. 5 shows a lamp-socket 1, with a generic lamp L, that has a protective cap 54 engaged. This protective cap 54 covers the connection bridge 4 and components attached to it. The cap 54 has a lateral orifice 55 where a cord 56 passes through. This cord 56 (as it has been explained when describing FIGS. 1 to 3), is tied to the lever arm 28 passing through orifice 44 for actuating the switching mechanism 11.

Figure 6:
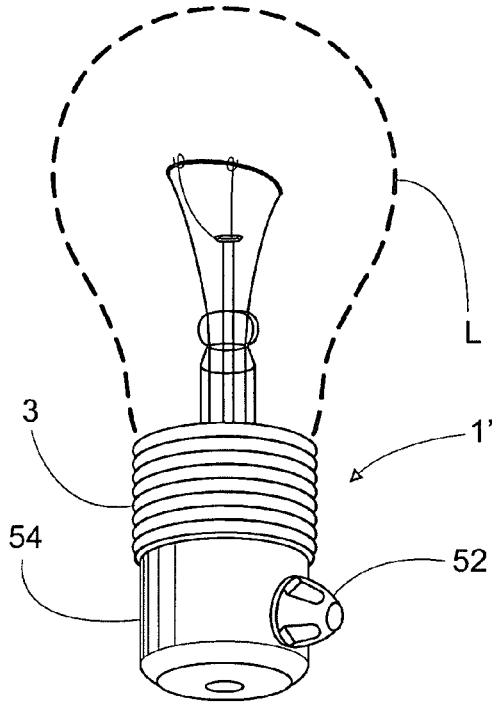

FIG. 6 shows a lamp-socket referenced as 1' with the aim of differentiate it respect the switching mechanism embodiment shown in FIG. 4. The lamp-socket 1' has attached a generic lamp L, a protective cap 54 covering the bridge with 4 connections and a knob 52 for actuating the switching mechanism conformed by revolving bushing 45.

Figure 7:
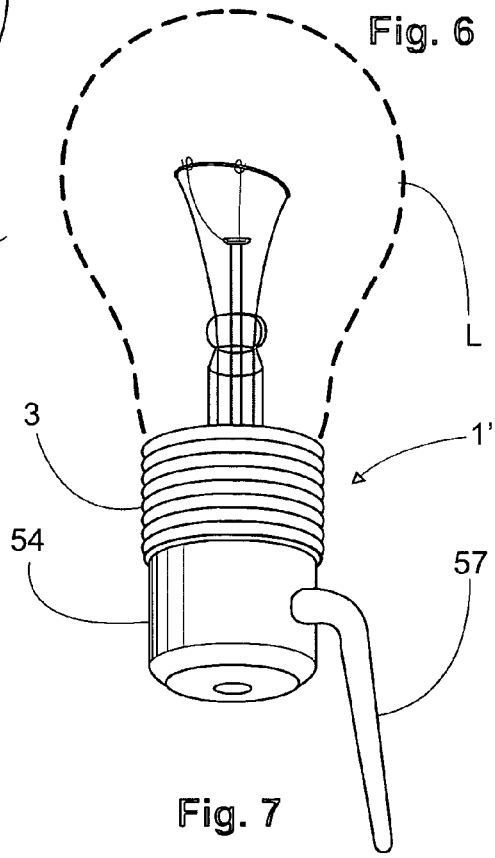

On the other hand, FIG. 7 also shows to the lamp-socket 1' of FIG. 6, in which knob 52 has been replaced by "L" shaped lever 57. As it has been explained above, by means of the lever 57 the switching mechanism (shown in FIG. 4) is actuated.

I claim:

1. Lamp-socket with built-in switch mechanism, wherein the switch mechanism is operated by a knob, a cord, a chain or a layer associated with a ratchet mechanism to close and to open power supply connection contacts of the lamp by means of corresponding terminals, the lamp-socket having, at a back side thereof, a connection bridge perpendicularly and centrally extending behind a lamp-socket tubular front part defining a lamp receiving cavity, said bridge being defined by a pair of lateral walls having lateral edges that are next to a contour of the lamp-socket front part and respective transversal upper edges defining a back end of the bridge, wherein the switch mechanism is connected in a lateral plane of the lamp-socket connection bridge and behind the lamp-socket tubular front part, the switch mechanism being arranged within a gap defined by a perimeter of the lamp-socket front part and by the connection bridge, and wherein the switch mechanism includes a ratchet sleeve having a front side to which a lever is connected for actuating the switch mechanism, the sleeve having a back side connected to a spiral electrical bridge in operative relation with a pair of contacts defining connection paths fixed on a lateral face of the connection bridge of the lamp-socket, the paths being extended according to respective annular steps formed on a sidewall of the connection bridge.

2. The lamp-socket of claim 1, wherein the front side of the ratchet sleeve has a plurality of inclined annular steps operatively connected to said lever.

3. The lamp-socket of claim 2, wherein the back side of the ratchet sleeve has a pair of diametrically opposed longitudinal grooves, with respective opposite lateral arms of the spiral electrical bridge engaging said longitudinal grooves, and wherein a spiral spring is housed in the ratchet sleeve for urging said spiral electrical bridge against said connection paths.

4. The lamp-socket of claim 3, wherein the lever is defined by a disc shaped portion and a lever arm projected laterally from the disc shaped portion, with a cord being connected to an end of the lever arm for actuating the switch mechanism, the lever having a back side where a cavity is defined and where a plurality of inclined annular steps is formed, the annular steps being in operative communication to the annular steps of the ratchet sleeve whereas a front side of the disc shaped portion of the lever has an annular cavity receiving a retractable spring for returning the lever to a resting position after any operation thereof.

5. The lamp-socket of claim 4, further comprising a cover affixed in front of the lever, the cover having a central orifice receiving a central tubular projection passing therethrough and forming part of the lever disc shaped portion, the retractile spring having a first end and a second end respectively placed into retention orifices formed in the lever and in said cover, the cover having lateral brackets for fixation to the connection bridge.

6. Lamp-socket with built-in switch mechanism, wherein the switch mechanism is operated by a knob, a cord, a chain or a lever associated with a ratchet mechanism to close and to open power supply connection contacts of the lamp by means of corresponding terminals, the lamp-socket having, at a back side thereof, a connection bridge perpendicularly and centrally extending behind a lamp-socket tubular front part defining a lamp receiving cavity, said bridge being defined by a pair of lateral walls having lateral edges that are next to a contour of the lamp-socket front part and respective transversal upper edges defining a back end of the bridge, wherein the switch mechanism is connected in a lateral plane of the lamp-socket connection bridge and behind the lamp-socket tubular front part, the switch mechanism being arranged within a gap defined by a perimeter of the lamp-socket front part and by the connection bridge, and wherein the switch mechanism includes a revolving bushing having a front side, wherein a switching mechanism actuating knob is connected, and a back side where a spiral electrical bridge is engaged, this spiral electrical bridge is in operative communication with a pair of contacts defining fixed connection paths on a lateral face of the connection bridge, and wherein the front side of the revolving bushing has a central tubular projection to which the switch mechanism actuating knob is connected, and wherein the back side of the revolving bushing has a pair of longitudinal diametrically opposed grooves to which respective opposite lateral brackets of spiral electrical bridge are connected, the electrical bridge being in operative communication with a pair of contacts defining fixed connected paths on a lateral face of the connection bridge and extending according to respective inclined annular steps defined on a sidewall of the connection bridge.

7. The lamp-socket of claim 6, wherein the tubular projection of the front side of the revolving bushing defines an polygonal shaped orifice, and wherein the switching mechanism actuating knob fits into said orifice.

8. The lamp-socket of claim 7, further comprising a cover affixed in front of the revolving bushing, the cover having the central orifice receiving a central tubular projection of the revolving bushing passing through the central orifice, and wherein the cover has lateral brackets for fixation in the connection bridge.

* * * * *